US010532267B2

(12) United States Patent
Guidetti

(10) Patent No.: US 10,532,267 B2
(45) Date of Patent: Jan. 14, 2020

(54) HARNESS WITH SINGLE-PULL ADJUSTMENT FOR SPORTS CHEST PROTECTOR

(71) Applicant: EASTON DIAMOND SPORTS, LLC, Thousand Oaks, CA (US)

(72) Inventor: Giovanni Guidetti, Canoga Park, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 314 days.

(21) Appl. No.: 15/588,554

(22) Filed: May 5, 2017

(65) Prior Publication Data

US 2018/0318692 A1 Nov. 8, 2018

(51) Int. Cl.
*A63B 71/12* (2006.01)
*A41D 13/00* (2006.01)

(52) U.S. Cl.
CPC ..... *A63B 71/12* (2013.01); *A41D 13/0007* (2013.01); *A63B 2071/1208* (2013.01)

(58) Field of Classification Search
CPC ..... A41D 13/0007; A63B 71/12
USPC ..... 450/463
See application file for complete search history.

(56) References Cited

U.S. PATENT DOCUMENTS 3,202,565 A * 8/1965 Loftin ..... A41C 3/0014 428/175
6,083,080 A * 7/2000 Lawson ..... A41C 3/10 450/39
6,233,740 B1 * 5/2001 Meyers ..... A41D 13/0007 2/102
6,688,942 B2 * 2/2004 Holliday ..... A41C 3/0057 450/1
7,001,239 B2 * 2/2006 Russell ..... A41C 3/005 2/267
7,442,110 B2 * 10/2008 Gaudet ..... A41C 3/0057 450/39
2007/0155283 A1 * 7/2007 McQueer ..... A41C 3/0057 450/39
2007/0190896 A1 * 8/2007 Yu ..... A41C 3/12 450/39

(Continued)

OTHER PUBLICATIONS

Best Buy Button & Buckle, "Ladder Locks", http://www.plastic-buckle.com/ladder-locks.aspx, exact publication date unknown (web page last visited May 5, 2017).

(Continued)

*Primary Examiner* — Gloria M Hale
(74) *Attorney, Agent, or Firm* — Perkins Coie LLP

(57) ABSTRACT

A chest protector includes a protective vest portion and a harness portion to hold the vest portion on a user. The harness portion includes a first side strap and a second side strap, each of the first and second side straps being connected to the vest portion on opposing sides of the vest portion; a first slide connected to the first side strap; a second slide connected to the second side strap; a central strap passing through the first slide and the second slide and forming a loop connecting the first and second slides; a vertical strap connected to the central strap; and a strap adjuster connecting the vest portion and the vertical strap. The vertical strap passes through the strap adjuster and a free end of the vertical strap can be pulled to tighten the harness portion around a user. The vertical strap may be the only adjustable strap.

20 Claims, 5 Drawing Sheets

(56) References Cited

U.S. PATENT DOCUMENTS

| | | | | |
|---|---|---|---|---|
| 2013/0316615 | A1* | 11/2013 | Hurd | A41C 3/0057 450/39 |
| 2016/0044971 | A1* | 2/2016 | Randall | A41C 3/142 450/39 |
| 2018/0161607 | A1* | 6/2018 | Jacob | A62B 35/0025 |

OTHER PUBLICATIONS

Strapworks, "Plastic Strap Adjusters", http://www.strapworks.com/Plastic_Strap_Adjusters_p/psa.htm, exact publication date unknown (web page last visited May 5, 2017).
Strapworks, "Slides, Loops, and Reducers", https://www.strapworks.com/Slides_Loops_Reducers_s/46.htm, exact publication date unknown (web page last visited May 5, 2017).
Strapworks, "Strapworks Spotlight on: Strap Adjusters", https://www.youtube.com/watch?v=BE2QgkMMe5M, May 11, 2013 (web page last visited May 5, 2017).

* cited by examiner

HARNESS WITH SINGLE-PULL ADJUSTMENT FOR SPORTS CHEST PROTECTOR

BACKGROUND

Traditional protective equipment for sports or industry, such as baseball or softball, may be difficult or time-consuming to don and adjust. For example, traditional catchers' chest protectors or vests worn to cover an anterior portion of a user may have several straps wrapping around a posterior half or back of the user to hold the chest protector in place. Those straps often need to be adjustable to accommodate different users' sizes or preferences.

Existing straps for protective equipment, such as catchers' chest protectors, may include multiple points of adjustment via a number of strap adjusters, strap ladder locks, or buckles. For example, in a traditional chest protector, a single strap may affect only the snugness of a single portion of the chest protector, such as one side, the neck area, or one shoulder portion. Because traditional straps affect only a single portion of the chest protector, multiple adjustments are necessary to realize the desired snugness of the other portions and the overall snugness of the chest protector. Multiple adjustments, however, take time and often result in an uneven fit. Multiple adjustments are also difficult for some users who may not be able to properly reach the several adjustment points while wearing a chest protector or other harness.

SUMMARY

A chest protector for a sports player may include a protective vest portion and a harness portion configured to adjustably hold the protective vest portion on the player. The harness portion may include a first side strap and a second side strap, each of the first and second side straps being connected to the protective vest portion on opposing sides of the protective vest portion; a first slide connected to the first side strap; a second slide connected to the second side strap; a central strap passing through the first slide and the second slide and forming at least part of a loop connecting the first slide and the second slide; a vertical strap connected to the central strap; and a strap adjuster connecting the protective vest portion to the vertical strap. The vertical strap passes through the strap adjuster, and a free end of the vertical strap is configured to be pulled, causing the vertical strap to pass further through the strap adjuster to decrease a distance between the strap adjuster and the central strap, which tightens the harness portion around a user's body. In some embodiments, the vertical strap may be the only adjustable strap, and the free end may be the only free end of the various straps.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to a harness with a single-pull adjustment for a sports chest protector, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as structures or functions common to catchers' chest protectors, straps, buckles, harnesses, or safety equipment in general may not be shown or described in detail so as to avoid unnecessarily obscuring the relevant description of the various embodiments. Accordingly, embodiments of the present technology may include additional elements or exclude some of the elements described below with reference to FIGS. 1-6, which illustrate examples of the technology.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components, and they may include direct or indirect attachments or connections.

Specific details of several embodiments of the present technology are described herein with reference to catchers' chest protectors for baseball or softball. Embodiments of the present technology may be used in other protective equipment or in other sports or industries, such as in safety harnesses, military vests, or other devices that utilize tightening or adjustment straps.

Figure 1:
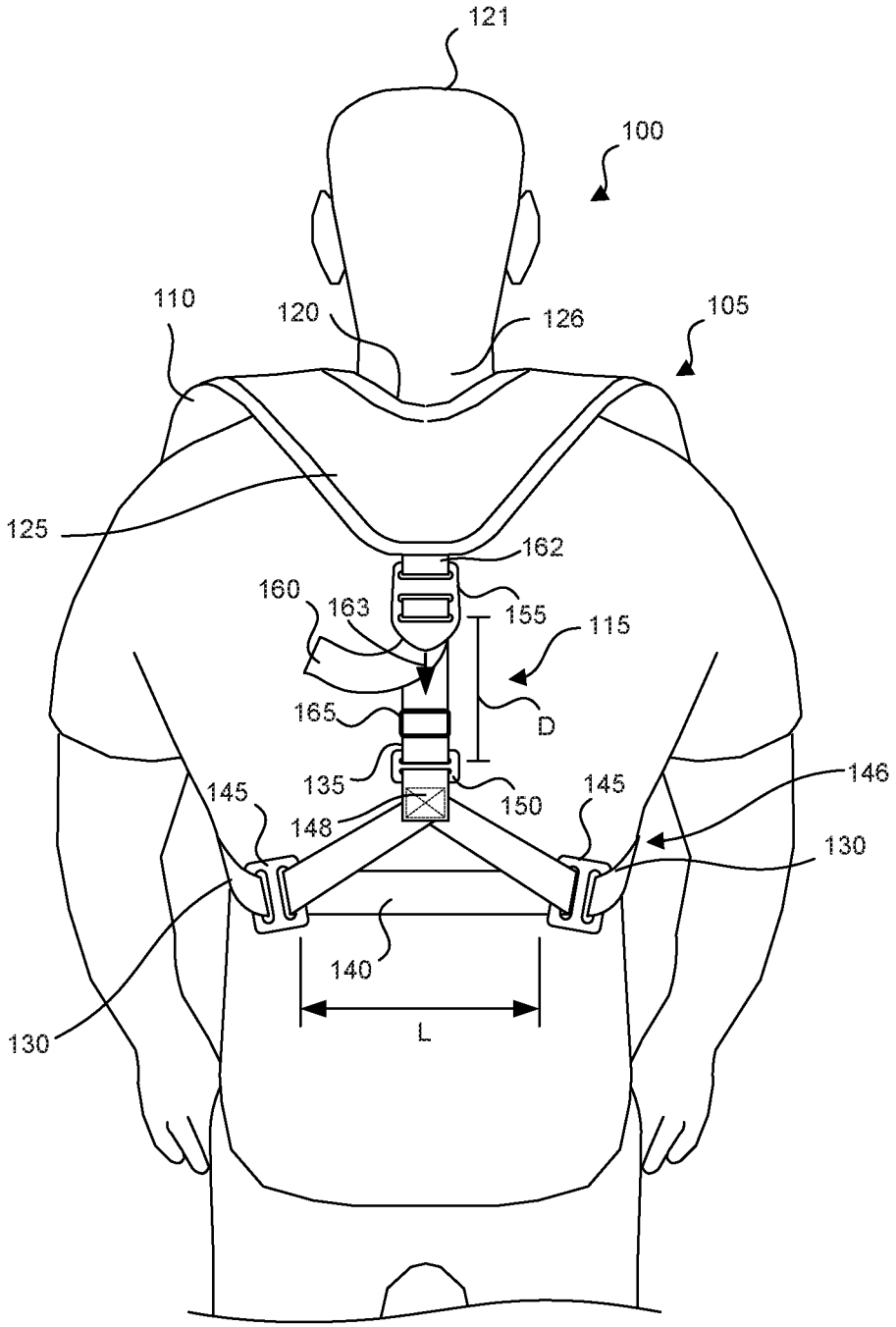
FIG. 1 illustrates a posterior view of a user wearing a catcher's chest protector according to an embodiment of the present technology.

Turning now to the drawings, FIG. 1 illustrates a posterior view of a user 100 wearing a catcher's chest protector 105 according to an embodiment of the present technology. The chest protector 105 includes a protective vest portion 110 and a harness portion 115 for holding the protective vest portion 110 on the user 100. The protective vest portion 110 may have an opening 120 through which a user's head 121 may pass when the user dons the chest protector 105. The protective vest portion 110 may have a posterior portion 125 that wraps behind the neck 126 of the user 100. The protective vest portion 110 may generally be similar to protective vest portions of existing catcher's chest protectors. For example, it may be padded, formed with breathable synthetic material, include one or more rigid portions, or it may be formed to provide cover for a user's shoulders, chest, abdominal area, or groin area.

The harness portion 115 may include a plurality of straps, such as one or more side straps 130 (which may extend generally horizontally or generally within a user's transverse plane), a vertical or spinal strap 135 (extending in a generally vertical direction or along a user's spine or vertical axis), and a central strap 140. In the illustrated embodiment, two side straps 130 are shown. Each of the side straps 130 may have one end that connects to the protective vest portion 110 and another end that connects to a side slide 145 (as described below). The side straps 130 may connect to the protective vest portion 110 at opposite sides of the protective vest portion 110 (see FIG. 6). The side straps 130 may connect directly to the protective vest portion 110 (such as with stitching, rivets, or adhesive), or they may indirectly connect to the protective vest portion 110 (such as with a releasable clip, button, buckle, snap, or other suitable permanent or releasable connection).

Each side slide 145 may be generally similar to slides known in the art. For example, the slides 145 may be generally rigid, flat elements having an opening for each strap to pass through. The end of each side strap 130 connected to the slide 145 may wrap around a portion of the slide 145 such that the side strap 130 does not slide relative to the slide 145, or it may be configured to slide through the slide 145. For example, each side strap 130 may be formed as a loop between the side slide 145 and a loop or D-ring connected to the protective vest portion 110 (such as the loop 660 in FIG. 6, described below). The side strap 130 may be adjustable or it may be a fixed length. In a particular representative embodiment, a length of the strap 130 between the protective vest portion 110 and the side slide 145 may be approximately 100 millimeters, or other suitable lengths depending on a user's size. If the side strap 130 is a loop, it may be formed from approximately 200 millimeters of material, for example, or other suitable lengths of material depending on a user's size.

The central strap 140 may pass through the side slides 145 to form a bottom portion 146 of the harness portion 115 that wraps around the middle or lower back area of the user 100. The central strap 140 may be positioned near a user's waist, below the level of a user's rib cage, or in other suitable locations. Two ends of the central strap 140 may be attached to each other to form a loop. For example, ends of the central strap 140 may be stitched, glued, riveted, or otherwise attached to each other. In some embodiments, the central strap 140 may be formed with a plurality of straps. In some embodiments, the central strap 140 may be attached to an intermediate strap 148, which may connect the central strap 140 to a spinal slide 150. In other embodiments, the central strap 140 may pass through the spinal slide 150 without the use of an intermediate strap 148. In a particular representative embodiment, the central strap 140 may have a total length of approximately 500 millimeters, or it may have other suitable lengths depending on the size of a user (for example, depending on whether an intended user is an adult or a child).

The spinal slide 150 may connect the spinal strap 135 to the central strap 140. The spinal strap 135 may be tightened or loosened according to embodiments of the present technology to provide a single-pull adjustment to the harness portion 115 of the chest protector 105, as described in further detail below.

The spinal strap 135 may pass through or be attached to the spinal slide 150 at one end and it may pass through a strap adjuster 155 at another end, which may include a free end 160. The strap adjuster 155 may be attached to the posterior portion 125 of the protective vest portion 110 directly or via an intermediate strap 162 or other intermediate connection. The strap adjuster 155 may be a strap-adjusting buckle known in the art (such as the type of strap-adjusting buckle found in a backpack strap, which is sometimes known as a ladder lock or ladder adjuster), and it may have teeth to grip the spinal strap 135 (like the teeth found on a similar buckle in a backpack strap). For example, when tension occurs in the harness portion 115, the teeth or other frictional aspects of the strap adjuster 155 may grip the spinal strap 135 in a manner similar to that in which known strap adjuster buckles maintain positions of straps. Accordingly, the strap adjuster 155 allows for adjustment of length and tension in the spinal strap 135.

In operation, in some embodiments, the spinal strap 135 may be the only strap that can be directly tightened or loosened by the user 100. For example, when a user pulls downwardly on the free end 160 of the spinal strap 135 in the direction of the arrow 163 in FIG. 1, a distance D between the spinal slide 150 and the strap adjuster 155 decreases, which increases the snugness of the chest protector 105 on the user 100. The spinal strap 135 will tend to pull the central strap 140 toward the strap adjuster 155. When the spinal strap 135 pulls the central strap 140 toward the strap adjuster 155, a distance L between the side slides 145 may also decrease, further increasing the snugness of the chest protector 105 on the user 100. As the user 100 pulls on the single free end 160 of the spinal strap 135, the central strap 140 and the side straps 130 of the harness portion 115 will generally tighten evenly around the body of the user 100. Accordingly, the present technology provides a single-pull adjustment that evenly tightens the harness portion 115 of the chest protector 105.

Optionally, in some embodiments, a traditional adjustment slide 165 may be implemented along the spinal strap 135. The traditional adjustment slide 165 allows a user 100 to lengthen or shorten the spinal strap 135 as a preliminary or separate adjustment to the harness portion 115 for custom snugness of the harness portion 115. The traditional adjustment slide 165 is optional and may be omitted in some embodiments, such that in some embodiments, the only adjustment to the distance D is accomplished with adjustment of the strap 135 through the strap adjuster 155. In some embodiments, traditional adjustment slides may optionally be fitted along other straps in the harness portion 115 for a more custom fit in addition to the single-pull fit provided by the strap adjuster 155 and the free end 160.

In some embodiments of the present technology, the straps (such as the central strap 140 and the spinal strap 135) may be formed from webbing, ribbon, strips of fabric, rope, or other material suitable for providing tension. In some embodiments, the straps may include nylon, polypropylene, cotton, or other suitable materials. In a particular representative embodiment, the straps may be formed with 38 millimeter-wide webbing. In other embodiments, the straps may be formed with other widths of webbing depending on requirements such as strength or cost, and straps may not all have the same width. In some embodiments, the slides and buckles (such as the side slides 145, the spinal slide 150, or the strap adjuster 155) may be made of plastic or metal, or another material suitable for providing structural strength, depending on the intended strength or cost characteristics of the harness portion 115.

Figure 2:
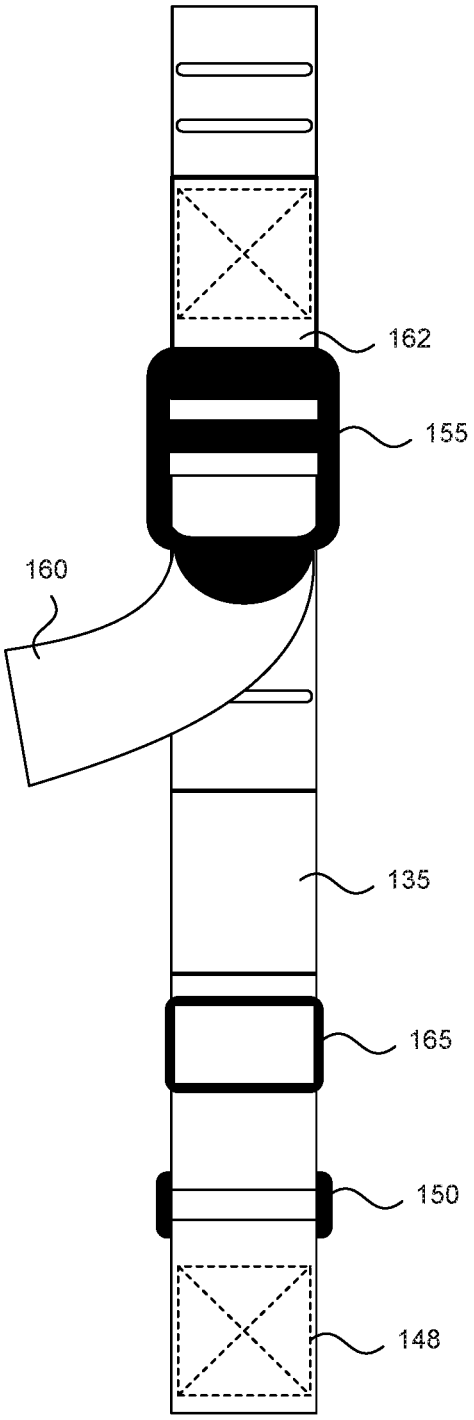
FIG. 2 illustrates a detailed view of part of the harness portion of the chest protector shown in FIG. 1.
Figure 3:
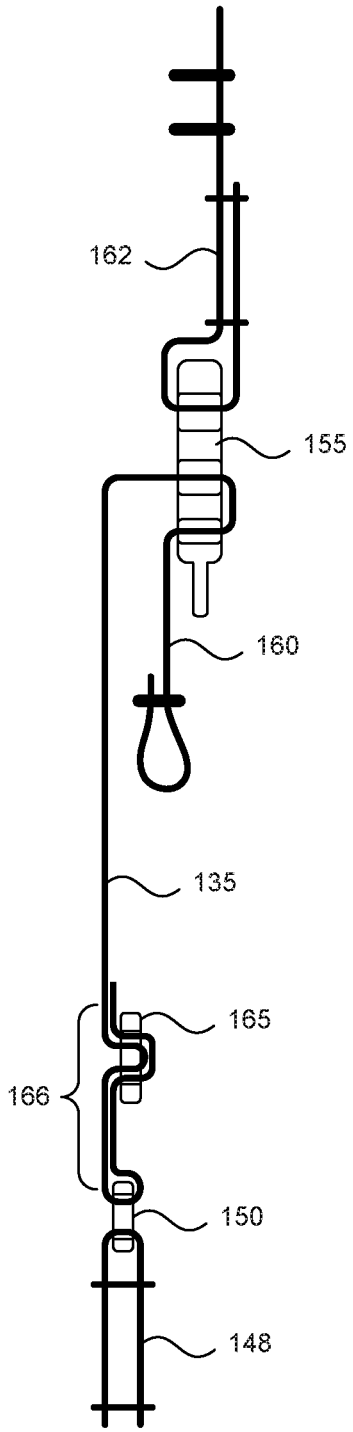
FIG. 3 illustrates a schematic cross-sectional side view of the part of the harness portion shown in FIG. 2.

FIG. 2 illustrates a detailed view of part of the harness portion 115 including the spinal strap 135, the spinal slide 150, the strap adjuster 155, and the optional traditional adjustment slide 165. FIG. 3 illustrates a schematic cross-sectional side view of the part of the harness portion shown in FIG. 2. FIGS. 2 and 3 illustrate adjustment of the harness portion according to a representative embodiment. The intermediate strap 148 loops through the spinal slide 150 to connect the central strap (140, see FIG. 1) to the spinal strap 135. The spinal strap 135 loops through the spinal slide 150 and through the optional traditional adjustment slide 165, which facilitates adjustment of a section 166 of the spinal strap 135. The spinal strap 135 also passes through the strap adjuster 155, with the free end 160 of the spinal strap 135 extending from the strap adjuster 155. By pulling on the free end 160, the user tightens the spinal strap 135 via the ladder lock (and optional teeth) of the strap adjuster 155. The strap adjuster 155 may connect to the protective vest portion (110, not shown) via the intermediate strap 162.

Figure 4:
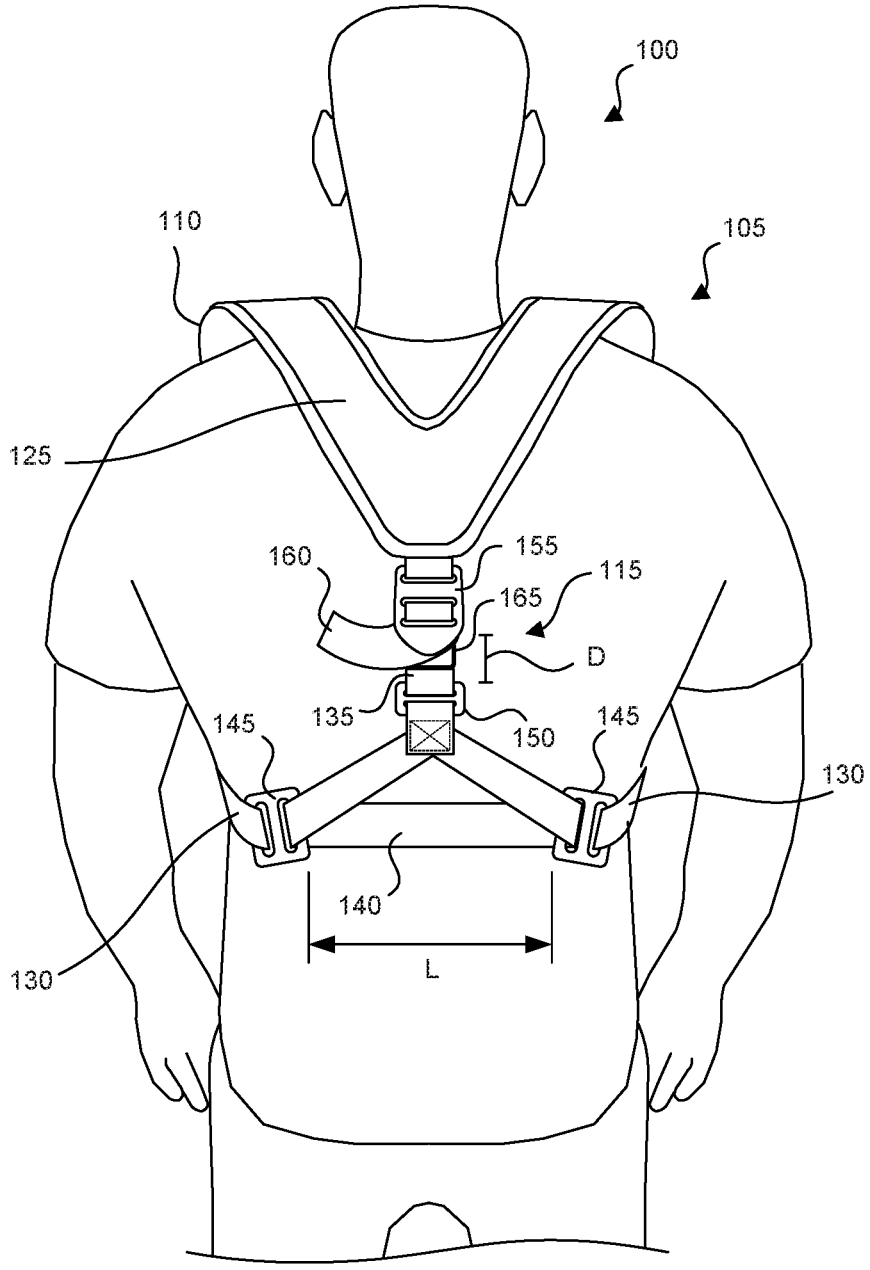
FIG. 4 illustrates the chest protector shown in FIG. 1 in a snugger configuration than in FIG. 1.

FIG. 4 illustrates the chest protector 105 in a snugger configuration than that shown in FIG. 1. For example, in FIG. 4, the spinal strap 135 has been tightened by pulling on the free end 160 so that the distance D between the strap adjuster 155 and the spinal slide 150 is decreased. The distance L between the side slides 145 is also decreased to increase the snugness of the harness portion 115 of the chest protector 105.

Figure 5:
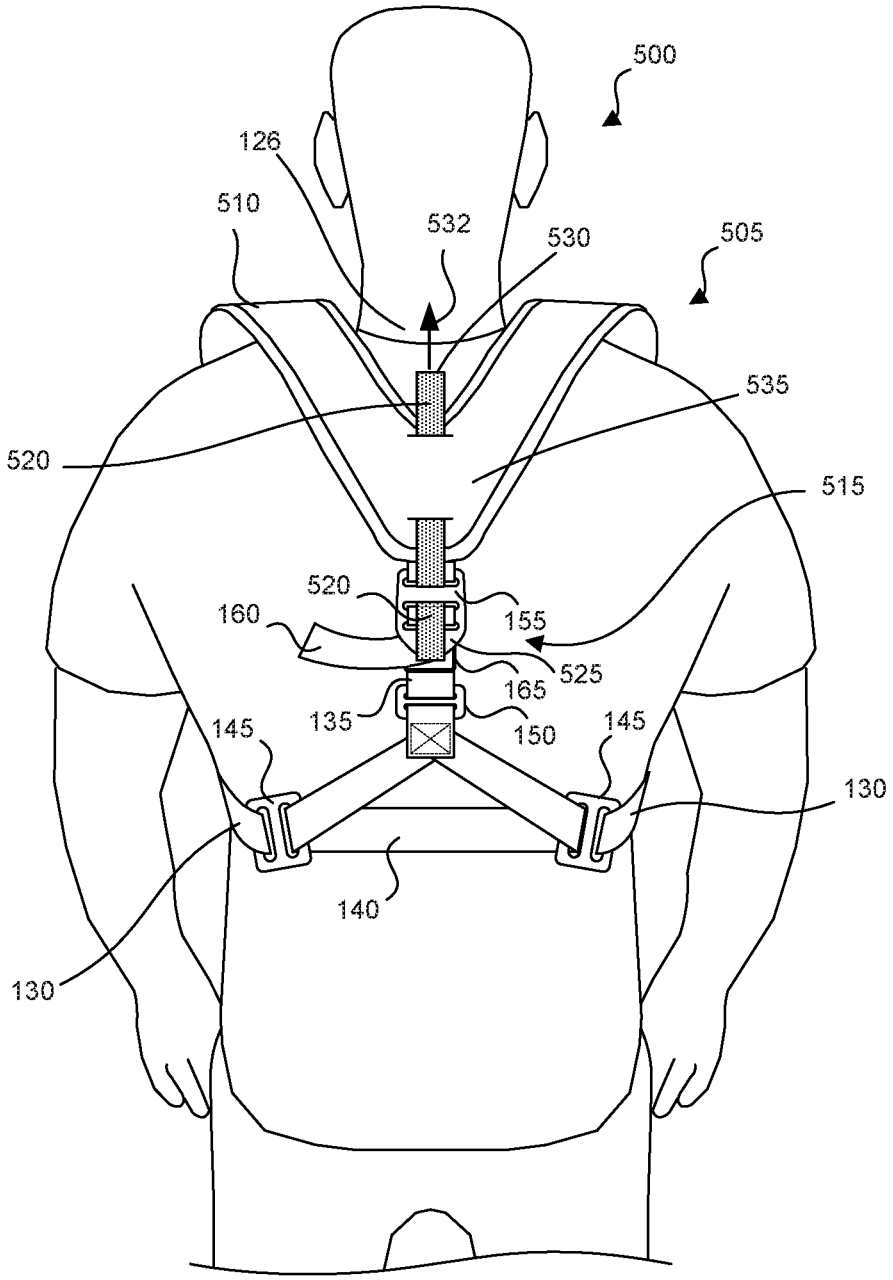
FIG. 5 illustrates a posterior view of a user wearing a catcher's chest protector according to another embodiment of the present technology.

FIG. 5 illustrates a posterior view of a user 500 wearing a catcher's chest protector 505 according to another embodiment of the present technology. The chest protector 505 includes a protective vest portion 510 and a harness portion 515 for holding the protective vest portion 510 on the user 500. The chest protector 505 may be generally similar to the chest protector 105 illustrated and described above with regard to FIGS. 1 and 4, but it further includes a release strap 520 for a user 500 to release tension or snugness in the harness portion 515 (for example, by releasing tension in the spinal strap 135).

The release strap 520 may be attached to a tab portion 525 of the strap adjuster 155 in a manner that enables a user to pull on a free end 530 of the release strap 520 to cause the tab portion 525 of the strap adjuster 155 to pull away from the spinal strap 135, releasing the teeth (not shown) of the strap adjuster 155 from the spinal strap 135 or otherwise decreasing friction between the strap adjuster 155 and the spinal strap 135. This allows the spinal strap 135 to loosen, resulting in overall loosening of the harness portion 515. In one embodiment, the user 500 may pull the release strap 520 upwardly in the direction of the arrow 532. The free end 530 of the release strap 520 may be positioned near the user's neck 126, allowing the user to easily access the free end 530 of the release strap 520 with one or both hands. For example, the release strap 520 may pass through the posterior portion 535 of the protective vest portion 510 such that the free end 530 is held near the user's neck 126 for access by the user's hands. In other embodiments, the free end 530 of the release strap 520 may be positioned elsewhere, for example, near the user's shoulders.

Although the foregoing describes a spinal slide 150 and a traditional adjustment slide 165, each of the spinal slide 150 and the traditional adjustment slide 165 is an optional feature, and either or both may be omitted in various embodiments.

Figure 6:
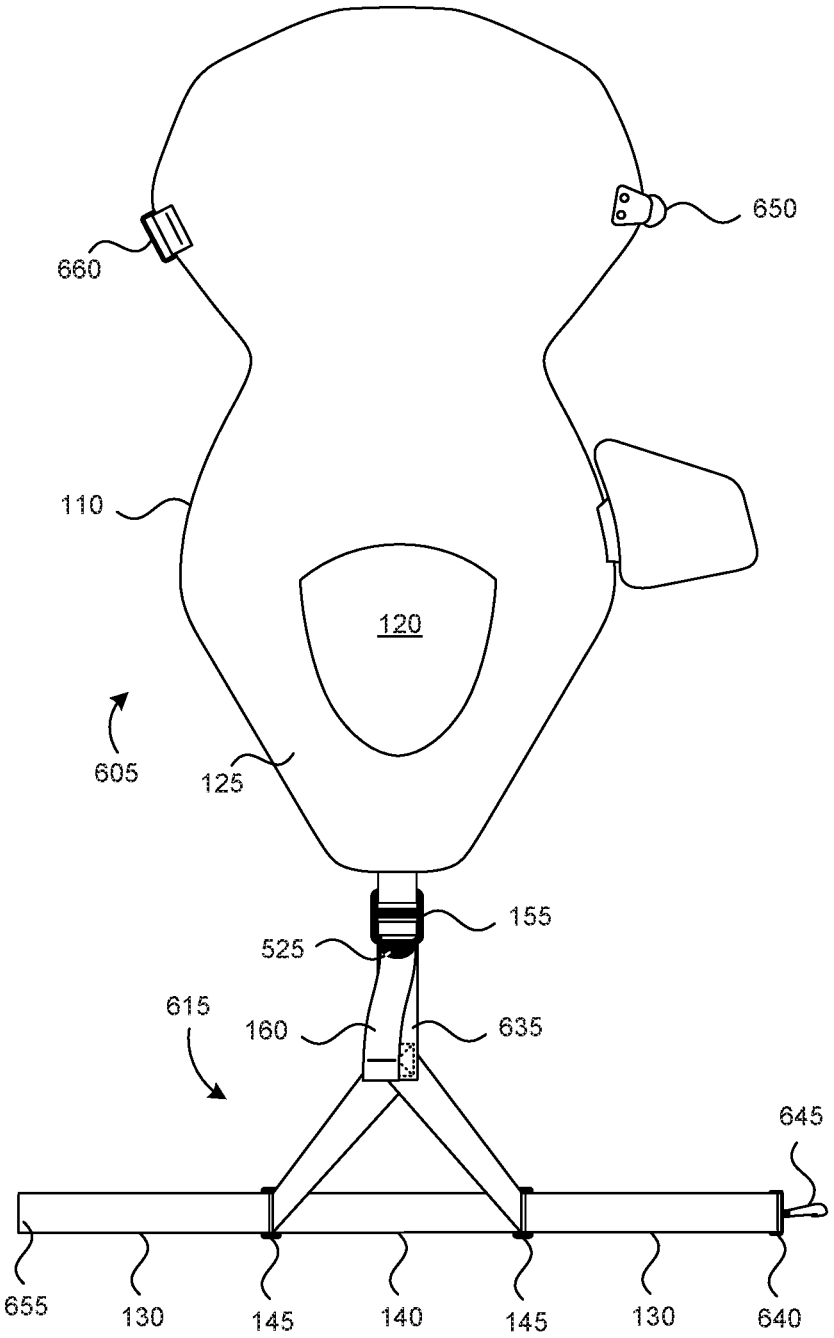
FIG. 6 illustrates a view of a chest protector in an open position in accordance with an embodiment of the present technology.

For example, FIG. 6 illustrates an open or flattened view of a chest protector 605 in accordance with an embodiment of the present technology. The chest protector 605 may be generally similar to the chest protectors (105, 505) described above, but the harness portion 615 of the chest protector 605 may omit the spinal slide and traditional adjustment slide. The chest protector 605 may also omit an intermediate strap (148, described above with regard to FIGS. 1-4) between the central strap 140 and the spinal strap 635, such that the central strap 140 and the spinal strap 635 are directly attached to each other. FIG. 6 also illustrates optional connections of the side straps 130 to the protective vest portion 110. A first end 640 of one side strap 130 may have a releasable hook 645 to connect to a first loop 650 on the protective vest portion 110. A second end 655 of another side strap 130 may permanently or releasably attach to a second loop 660 on an opposite side of the protective vest portion 110 from the first loop 650.

Embodiments of the present technology provide a chest protector (for example, 105, 505, 605) having a harness portion (for example, 115, 515, 615) that may be tightened by pulling on the free end 160 of the spinal strap (135, 635), and loosened by pulling on the tab portion 525 of the strap adjuster 155, either directly or by using the release strap 520. Accordingly, embodiments of the present technology avoid the need for multiple adjustment points by providing a single-pull tightening and a single-pull release of the harness portion (115, 515, 615). In other words, embodiments of the present technology provide an adjustable harness system that accommodates a variety of anthropometric dimensions with reduced effort or complexity, for example, with only one movement to tighten and one movement to loosen the system. These embodiments may also provide even distribution of slack due to the positioning of various slides (such as the side slides 145) and the manner in which snugness is adjusted simultaneously relative to three points of attachment with the vest portion. In some embodiments, additional straps may be used, such that more points are adjusted with a single pull.

Although embodiments of the present technology are described herein in the context of a baseball or softball catcher's chest protector, in other embodiments, the technology may be used in other sports, industries, or applications. For example, embodiments of the harness portions may be used to tighten a safety harness, a military vest (such as a bullet resistant plate carrier or tactical supply vest), a cooking apron, or other pieces of safety equipment or apparel. Accordingly, the technology described herein may be implemented in any suitable arrangement of straps or harnesses in which a simplified tightening and loosening system is advantageous.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in various embodiments of the technology, intermediate straps (such as the intermediate straps 148, 162 shown in the figures) may be omitted in favor of one or more direct connections. In some embodiments, the strap adjuster 155 may not include a tab portion 525, and the release strap 520 may attach to another suitable portion of the strap adjuster 155. In some embodiments, there may be more straps than what have been illustrated or described, and such straps may pass through additional slides and adjusters. In various embodiments, connections between elements such as straps may be accomplished by bar stitching, x-box stitching, or other suitable forms of stitching, riveting, stapling, or other connections capable of enduring stress and wear. In various embodiments, not every element is required and certain elements may be omitted or combined.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A chest protector for a sports player, the chest protector comprising a protective vest portion and a harness portion configured to adjustably hold the protective vest portion on the player, the harness portion comprising:

a first side strap and a second side strap, each of the first and second side straps being connected to the protective vest portion on opposing sides of the protective vest portion;

a first slide connected to the first side strap;

a second slide connected to the second side strap;

a central strap passing through the first slide and the second slide and forming at least part of a loop connecting the first slide and the second slide;

a vertical strap connected to the central strap; and a strap adjuster connecting the protective vest portion and the vertical strap; wherein the vertical strap passes through the strap adjuster, and a free end of the vertical strap is configured to be pulled to cause the vertical strap to pass further through the strap adjuster to decrease a distance between the strap adjuster and the central strap to tighten the harness portion.

2. The chest protector of claim 1, further comprising a third slide connecting the central strap and the vertical strap.

3. The chest protector of claim 1, further comprising an intermediate strap connecting the strap adjuster and the protective vest portion.

4. The chest protector of claim 1 wherein the strap adjuster is a first strap adjuster, the chest protector further comprising a second strap adjuster positioned on the vertical strap and configured to adjust a distance between the first strap adjuster and the central strap.

5. The chest protector of claim 1, further comprising a release strap connected to the strap adjuster, the release strap having a free end configured to be pulled by a user to release the strap adjuster to allow the harness to loosen.

6. The chest protector of claim 5 wherein the release strap passes through a portion of the protective vest portion.

7. The chest protector of claim 1 wherein the vertical strap is the only adjustable strap in the harness portion.

8. A chest protector for a sports player, the chest protector comprising a protective vest portion and a harness portion configured to adjustably hold the protective vest portion on the player, the harness portion comprising:

a plurality of straps, the plurality of straps comprising side straps, a vertical strap, and a central strap connecting the side straps to the vertical strap, wherein the side straps are connected to the protective vest portion; and a strap adjuster; wherein the vertical strap passes through the strap adjuster, the strap adjuster is configured to facilitate adjustment of a distance between the strap adjuster and the central strap, and wherein when a free end of the vertical strap is pulled, the vertical strap pulls the central strap to tighten the harness portion.

9. The chest protector of claim 8 wherein the central strap comprises a loop between the side straps.

10. The chest protector of claim 9 wherein the central strap is connected to the side straps via slides.

11. The chest protector of claim 8 wherein the vertical strap is connected to the central strap via a slide.

12. The chest protector of claim 8, further comprising a release strap attached to the strap adjuster, wherein the release strap is configured to facilitate release of the strap adjuster to allow release of tension in the harness portion.

13. The chest protector of claim 8, wherein the strap adjuster is a first strap adjuster, and wherein the harness portion comprises a second strap adjuster configured to adjust tension in the vertical strap.

14. The chest protector of claim 8 wherein the side straps and the central strap are configured to tighten around a user's body when the free end of the vertical strap is pulled.

15. The chest protector of claim 8 wherein the free end of the vertical strap is the only free end of any of the vertical strap, the side straps, and the central strap.

16. A chest protector for a sports player, the chest protector comprising a protective vest portion and a harness portion attached to the protective vest portion and configured to adjustably hold the protective vest portion on the player, the harness portion comprising a system for tightening and loosening the harness portion, the system comprising:

a central strap forming a loop between two side straps and a vertical strap;

means for increasing tension on the vertical strap, the means for increasing tension comprising a first strap adjuster; and means for loosening tension on the vertical strap, the means for loosening tension comprising the first strap adjuster; wherein when tension is increased in the vertical strap, tension is increased in the central strap and in the side straps.

17. The chest protector of claim 16, wherein the means for loosening tension comprises a release strap attached to the first strap adjuster.

18. The chest protector of claim 16, further comprising a plurality of slides to connect the central straps to the side straps, and the central shape slides relative to the side straps.

19. The chest protector of claim 16 wherein the means for increasing tension further comprises a second strap adjuster.

20. The chest protector of claim 16 wherein the means for increasing tension comprises a free end of the vertical strap, and wherein the free end of the vertical strap is the only free end of any of the vertical strap, the side straps, and the central strap.

* * * * *